US006345998B1

(12) United States Patent
Lee

(10) Patent No.: US 6,345,998 B1
(45) Date of Patent: Feb. 12, 2002

(54) FLEXIBLE PRINTED CIRCUIT CONNECTOR

(75) Inventor: Ipson Lee, Taoyuan (TW)

(73) Assignee: Super Link Electronics Co., Ltd., Taoyan (TW)

( * ) Notice: Subject to any disclaimer, the term of this patent is extended or adjusted under 35 U.S.C. 154(b) by 0 days.

(21) Appl. No.: 09/867,481

(22) Filed: May 31, 2001

(30) Foreign Application Priority Data

May 4, 2001 (KR) ..... 090207303

(51) Int. Cl.[7] ..... H01R 13/15
(52) U.S. Cl. ..... 439/260; 439/492; 439/495
(58) Field of Search ..... 439/260, 261, 439/77, 571, 572, 329, 493, 492, 495

(56) References Cited

U.S. PATENT DOCUMENTS 5,695,360 A * 12/1997 Seto et al. ..... 439/495
5,842,883 A * 12/1998 Igarashi et al. ..... 439/495
6,099,346 A * 8/2000 Hashiguchi et al. ..... 439/495
6,116,947 A * 9/2000 Takayasu ..... 439/495
6,203,345 B1 * 3/2001 Roque et al. ..... 439/260
6,224,418 B1 * 5/2001 Miura et al. ..... 439/495
6,254,406 B1 * 7/2001 Chiu et al. ..... 439/142
6,267,620 B1 * 7/2001 Ma ..... 439/495
6,283,779 B1 * 9/2001 Lung ..... 439/260

* cited by examiner

*Primary Examiner*—Tulsidas Patel
(74) *Attorney, Agent, or Firm*—Rosenberg, Klein & Lee

(57) ABSTRACT

Flexible printed circuit connector including: an insulating base seat each end of which is formed with an insertion hole; multiple conductive members inlaid in the insulating base seat for electrically contacting with the flexible printed circuit; two metal pivot members respectively inlaid in two ends of the insulating base seat; and a metal press board two ends of which are pivotally connected with the metal pivot members. Two ends of the metal press board are respectively latched with the metal pivot

7 Claims, 4 Drawing Sheets

FLEXIBLE PRINTED CIRCUIT CONNECTOR

BACKGROUND OF THE INVENTION

The present invention is related to a flexible printed circuit connector (or so-called "soft" printed circuit connector ).

A flexible printed circuit (F.P.C) or "soft" printed circuit is mainly applied to personal computer such as a notebook-type computer or an electronic dictionary which is used in a flexed state. The flexible printed circuit must meet the requirement of light weight, thinness and small volume for easy carriage. The connector for connecting with the flexible printed circuit must meet the same requirement.

FIG. 4 shows a typical flexible printed circuit board. The inner sides of two ends of the plastic cover 5 of the connector are respectively integrally formed with two inward extending pivot shafts 521 for slidably fitting into the channels 161 of two sides of the plastic casing 1. Accordingly, the plastic cover 5 can be pivotally rotated from the casing 1 to take out the flexible printed circuit from the connector 10. The cover 5 can be closed to fix the flexible printed circuit in the connector 10.

The connector 10 has very small volume and the pivot shafts 521 of the cover 5 thereof are even smaller. Therefore, when pivotally rotating the cover 5 from the casing 1, the sophisticated pivot shafts 521 are very likely to break or wear. This will make the entire connector 10 lose its function of connection.

The plastic cover 5 has a considerable width while a slender cross-section. Accordingly, the pressing or fixing effect provided by the cover 5 for the flexible printed circuit is limited. after flexed many times, the flexible printed circuit extremely tends to detach from the connector 10.

In the case that the plastic cover 5 is enlarged for enhancing the connection between the connector 10 and the flexible printed circuit, inevitably the connector 10 will be too large and too thick. This fails to meet the requirement of light weight, thinness and small volume of the notebook-type personal computer.

SUMMARY OF THE INVENTION

It is therefore a primary object of the present invention to provide a flexible printed circuit connector in which the metal press board for pressing the flexible printed circuit is thinner, while having greater structural strength.

It is a further object of the present invention to provide the above flexible printed circuit connector in which the pivot members connected between two ends of the insulating base seat and the press board are made of thin metal board so that the pivot members are not subject to damage even after many times pivotally rotated.

According to the above objects, the flexible printed circuit connector of the present invention includes: an insulating base seat having a longitudinally extending seat body, each end of the insulating base seat being formed with an insertion hole; multiple conductive members inlaid in the insulating base seat for electrically contacting with the flexible printed circuit; two metal pivot members respectively connected with two ends of the insulating base seat in such a manner that each metal pivot member has an inlay section inlaid in the insertion hole of one end of the insulating base seat, whereby the metal pivot members are fixed on the insulating base seat, each metal pivot member having a first pivot section and a first latch section; and a metal press board, each of two ends of the metal press board being formed with a second pivot section and a second latch section, the second pivot sections being respectively pivotally connected with the first pivot sections of the metal pivot members fixed at two ends of the insulating base seat, whereby the metal press board is pivotally rotatable about the metal pivot members and the insulating base seat, when the metal press board is pivotally rotated and closed to the metal pivot members and the insulating base seat, the second latch sections of the metal press board being latched with the first latch sections of the metal pivot members.

In the above flexible printed circuit connector, the first pivot sections are arched guide slots.

In the above flexible printed circuit connector, the second pivot sections are pivot lugs which are inward bent opposite to each other.

In the above flexible printed circuit connector, the metal pivot member has an L-shaped cross-section.

In the above flexible printed circuit connector, the inlay section of the metal pivot member extends from the extends from the L-shaped cross-section of the metal pivot member to form a U-shaped cross-section.

In the above flexible printed circuit connector, the insertion hole of the insulating base seat is normal to the longitudinal seat body thereof.

In the above flexible printed circuit connector, each metal pivot member further has a stop section adjacent to the first pivot section and outward extending therefrom for stopping the metal press board, whereby after the metal press board is turned up, it is leant on the stop section.

The present invention can be best understood through the following description and accompanying drawings wherein:

DETAILED DESCRIPTION OF THE PREFERRED EMBODIMENT

Figure 1:
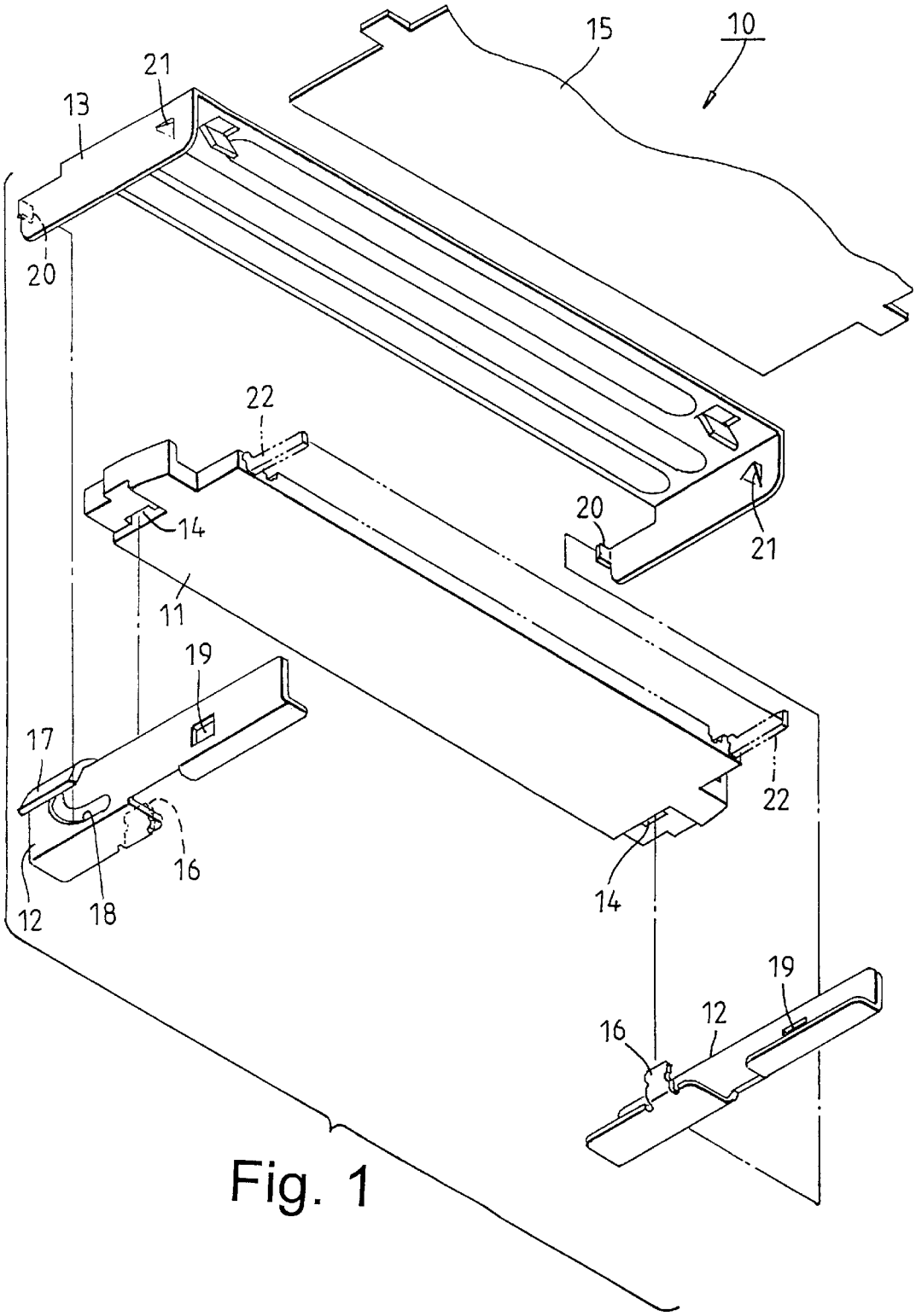
FIG. 1 is a bottom perspective exploded view of the present invention.
Figure 2:
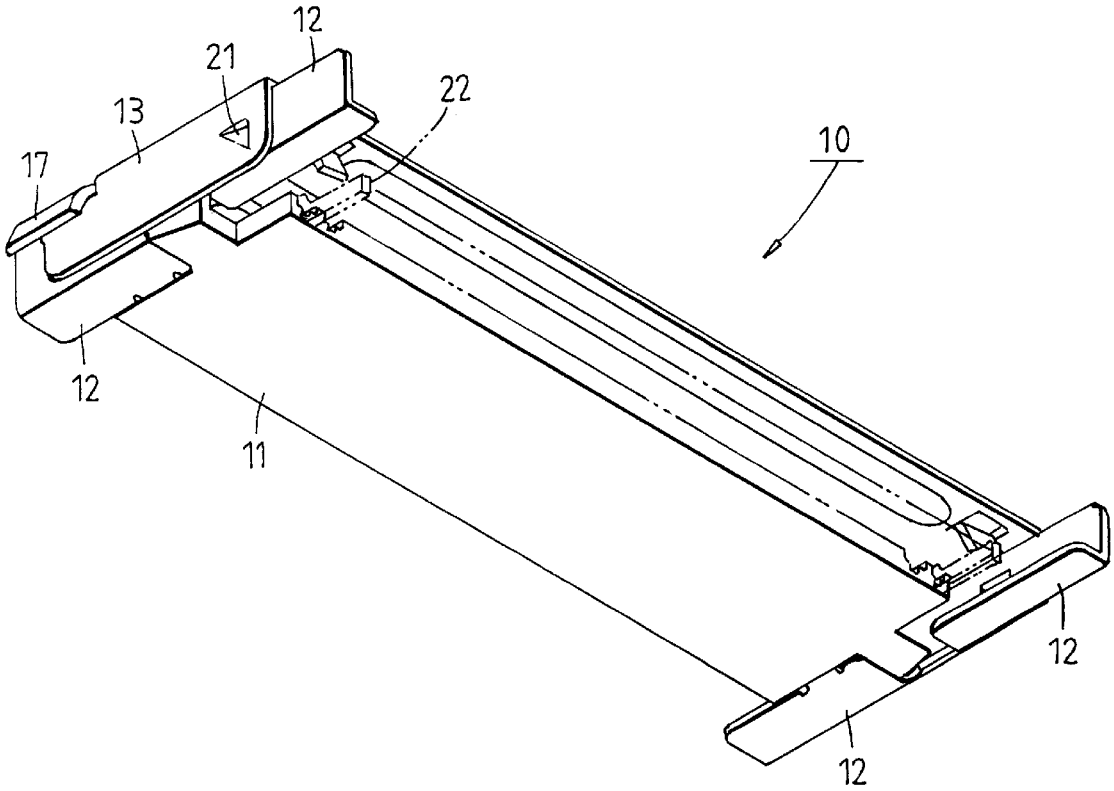
FIG. 2 is a bottom perspective assembled view of the present invention.
Figure 3:
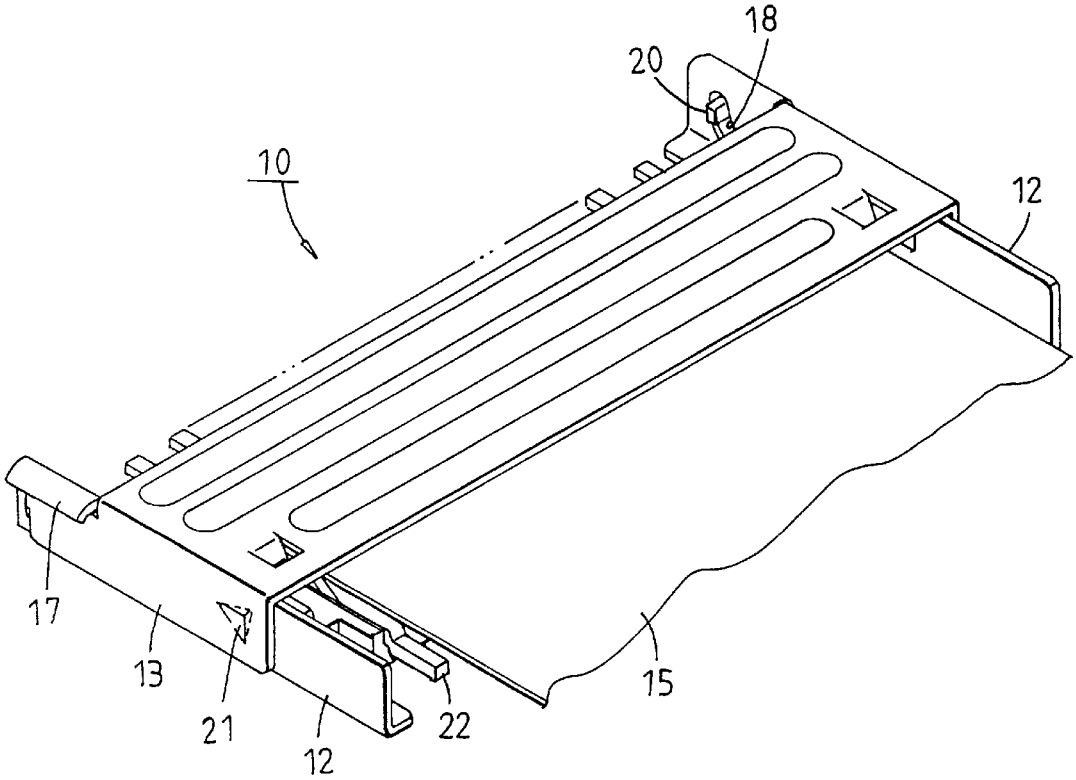
FIG. 3 is a top perspective assembled view of the present invention.
Figure 4:
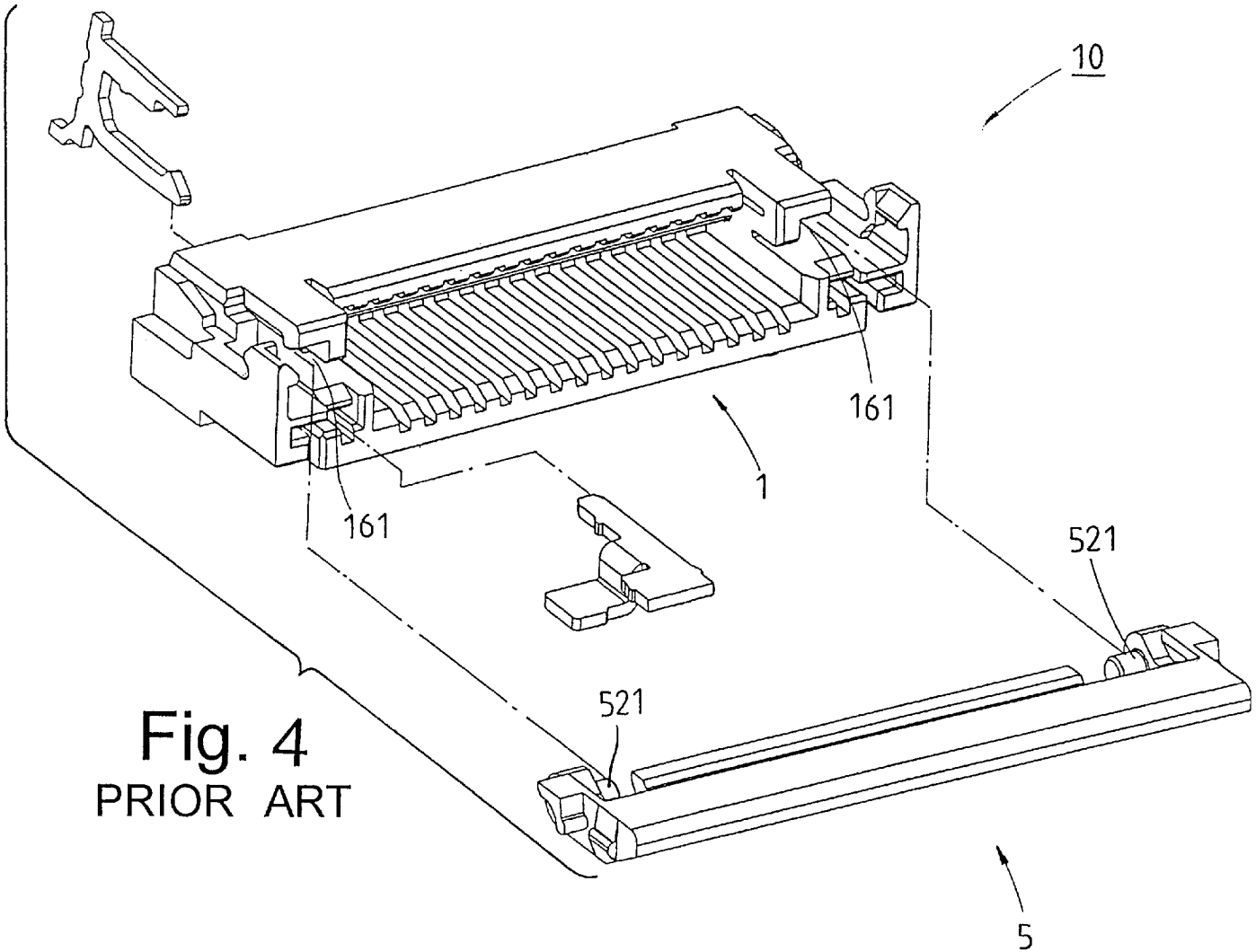
Fig. 4 PRIOR ART
FIG. 4 is a perspective exploded view of a conventional flexible printed circuit connector.

Please refer to FIGS. 1, 2 and 3. The flexible printed circuit connector 10 of the present invention includes an insulating base seat 11, two metal pivot members 12 and a metal press board 13.

The insulating base seat 11 has a longitudinally extending seat body. Each end of the base seat 11 is formed with an insertion hole 14 normal to the longitudinal seat body. Multiple conductive members 22 are inlaid in the base seat 11 for electrically contacting with the flexible printed circuit 15.

The two metal pivot members 12 are respectively connected with two ends of the insulating base seat 11 in such a manner that each metal pivot member 12 has an inlay section 16 inlaid in the insertion hole 14 of one end of the insulating base seat 11. Accordingly, the metal pivot members 12 are fixed on the insulating base seat 11. Each metal pivot member 12 has a first pivot section 18 and a first latch section 19.

Each of two ends of the metal press board 13 is formed with a second pivot section 20 and a second latch section 21.

The second pivot sections 20 are respectively pivotally connected with the first pivot sections 18 of the metal pivot members 12 fixed at two ends of the insulating base seat 11. Therefore, the metal press board 13 can be pivotally rotated about the metal pivot members 12 and the insulating base seat 11. When the metal press board 13 is pivotally rotated and closed to the metal pivot members 12 and the insulating base seat 11, the second latch sections 21 of the metal press board 13 are latched with the first latch sections 19 of the metal pivot members 12.

The metal press board 13 directly electrically contacts with the metal pivot members 12 to achieve a grounding effect for the connector. This is not achievable by the plastic connector.

In this embodiment, the first pivot sections 18 are arched guide slots, while the second pivot sections 20 are pivot lugs which are inward bent opposite to each other. In addition, the metal pivot member 12 has an L-shaped cross-section. The inlay section 16 extends from the L-shaped cross-section of the metal pivot member 12 to form a U-shaped cross-section.

Each metal pivot member 12 further has a stop section 17 adjacent to the first pivot section 18 and outward extending therefrom for stopping the metal press board 13. Accordingly, after the metal press board 13 is turned up, it is leant on the stop section 17.

When assembled, the inlay sections 16 of the two metal pivot members 12 are first inserted into the insertion holes 14 of two ends of the insulating base seat 11. Then, the metal press board 13 is bridged between two sides of the metal pivot members 12. Then, the second pivot sections 20 of the two ends of the metal press board 13 are slided into the first pivot sections 18 which are arched guide slots in this embodiment.

The present invention has the following advantages:

1. The metal press board of the flexible printed circuit connector for pressing the flexible printed circuit is thinner, while having greater structural strength.
2. The pivot members connected between two ends of the insulating base seat and the press board are made of thin metal board so that the pivot members are not subject to damage even after many times pivotally rotated.

The above embodiment is only used to illustrate the present invention, not intended to limit the scope thereof. Many modifications of the above embodiment can be made without departing from the spirit of the present invention.

What is claimed is:

1. Flexible printed circuit connector comprising:

an insulating base seat having a longitudinally extending seat body, each end of the insulating base seat being formed with an insertion hole;

multiple conductive members inlaid in the insulating base seat for electrically contacting with the flexible printed circuit;

two metal pivot members respectively connected with two ends of the insulating base seat in such a manner that each metal pivot member has an inlay section inlaid in the insertion hole of one end of the insulating base seat, whereby the metal pivot members are fixed on the insulating base seat, each metal pivot member having a first pivot section and a first latch section; and a metal press board, each of two ends of the metal press board being formed with a second pivot section and a second latch section, the second pivot sections being respectively pivotally connected with the first pivot sections of the metal pivot members fixed at two ends of the insulating base seat, whereby the metal press board is pivotally rotatable about the metal pivot members and the insulating base seat, when the metal press board is pivotally rotated and closed to the metal pivot members and the insulating base seat, the second latch sections of the metal press board being latched with the first latch sections of the metal pivot members.

2. Flexible printed circuit connector as claimed in claim 1, wherein the first pivot sections are arched guide slots.

3. Flexible printed circuit connector as claimed in claim 2, wherein the second pivot sections are pivot lugs which are inward bent opposite to each other.

4. Flexible printed circuit connector as claimed in claim 1, wherein the metal pivot member has an L-shaped cross-section.

5. Flexible printed circuit connector as claimed in claim 4, wherein the inlay section of the metal pivot member extends from the extends from the L-shaped cross-section of the metal pivot member to form a U-shaped cross-section.

6. Flexible printed circuit connector as claimed in claim 5, wherein the insertion hole of the insulating base seat is normal to the longitudinal seat body thereof.

7. Flexible printed circuit connector as claimed in claim 4, wherein each metal pivot member further has a stop section adjacent to the first pivot section and outward extending therefrom for stopping the metal press board, whereby after the metal press board is turned up, it is leant on the stop section.

* * * * *